United States Patent [19]

Palazzolo et al.

[11] 4,279,110

[45] Jul. 21, 1981

[54] CEILING MIRROR ASSEMBLY

[76] Inventors: Paul H. Palazzolo, 21154 Hale, Mount Clemens, Mich. 48043; Joseph J. Dinardo, 2869 Ellsworth, Richmond, Mich. 48062

[21] Appl. No.: 22,065

[22] Filed: Mar. 19, 1979

[51] Int. Cl.[3] ..... E04B 5/57

[52] U.S. Cl. ..... 52/302; 52/393; 52/484; 52/489; 24/259 FS

[58] Field of Search ..... 52/483, 484, 489, 511, 52/766, 768, 769, 302, 393; 85/3 R; 428/433

[56] References Cited

U.S. PATENT DOCUMENTS

| | | | |
|---|---|---|---|
| 978,380 | 12/1910 | Kennedy | 85/3 R |
| 1,052,731 | 2/1913 | Law | 85/3 R |
| 1,179,449 | 4/1916 | Newhall | 85/3 R |
| 1,733,693 | 10/1929 | Porter | 85/3 R |
| 1,997,607 | 4/1935 | Strom | 52/489 |
| 2,070,150 | 2/1937 | Venzie | 52/489 |
| 3,043,548 | 7/1962 | Jorgensen | 52/484 |
| 3,184,017 | 5/1965 | Gravenor | 52/483 |
| 3,325,954 | 6/1967 | Olson | 52/484 |
| 3,973,368 | 4/1976 | Moeller | 52/484 |
| 4,016,324 | 4/1977 | Cooke | 428/433 |

FOREIGN PATENT DOCUMENTS

| | | | |
|---|---|---|---|
| 1213772 | 4/1960 | France | 52/484 |
| 1340294 | 9/1963 | France | 52/484 |

*Primary Examiner*—John E. Murtagh
*Assistant Examiner*—Henry E. Raduazo
*Attorney, Agent, or Firm*—Burton, Parker & Schramm

[57] ABSTRACT

A suspended ceiling panel assembly particularly where one side of the panel is a mirror. The assembly to be suspended from supports. On the panel is a hanger, and a locking member is pivotally joined to the hanger. The locking member has a stable position which allows it to be hung from the supports. The locking member is pivotable out of its stable position to a second stable position which allows the panel to be removed from the support.

12 Claims, 7 Drawing Figures

CEILING MIRROR ASSEMBLY

BACKGROUND OF THE INVENTION

This invention relates to ceiling panel assemblies, especially when the panels include a mirrored surface. More particularly, this invention relates to the placing of mirrors into a standard grid system so they may be suspended from a ceiling but may be individually removed without damaging the mirrors and without requiring the removal of adjoining portions of the grid.

DISCUSSION OF THE PRIOR ART

It is now common for suspended ceilings to be used in many structures. In some areas the use of suspended mirrors is desired. Due to the weight and rigidity of mirrors, many of the systems which may be used for other types of ceiling panels may not be used for mirrored panels, especially when the space above the panel is limited. Mirrored panels also cause additional problems in that their surfaces may be marred more easily than many ceiling surfaces, and hence require more frequent replacement of individual panels. In the past the removal of individual rigid panels has often been difficult. Another problem faced in the area of using mirrors on ceiling surfaces is that the panel must be securely in place since in addition to the normal problems of a falling panel, flying glass might result from damage to the mirrored surface. Finally, it is desired in many ceilings to provide adequate air flow between the space above and below the panels for ventilation.

SUMMARY OF THE INVENTION

This invention is designed to overcome the disadvantages of the prior art. Generally it will be used with inverted T support rails which are common in the prior art where they are formed into grid systems leaving square spaces to be covered by panels. The panel assembly of applicant's invention is maintained upon the supports by means of a locking member which is pivotally joined to a hanger which holds up the panel. The locking member is such that it has a stable position which allows it to be hung upon the support. The locking member, however, is pivotable out of its stable position so to allow disengagement with its support, which in turn allows the panel to be removed from the grid system. This pivoting may be to a second stable position.

The invention is particularly suited for mirrored panels and in its preferred embodiment the locking assembly is characterized by the locking member and hanger being joined by a hanger tab inserted through a hole in the locking member, where, when the tab is located at either of two recesses characterizing the outline of the hole, the locking member will be in a stable position.

DESCRIPTION OF PREFERRED EMBODIMENT

Figure 1:
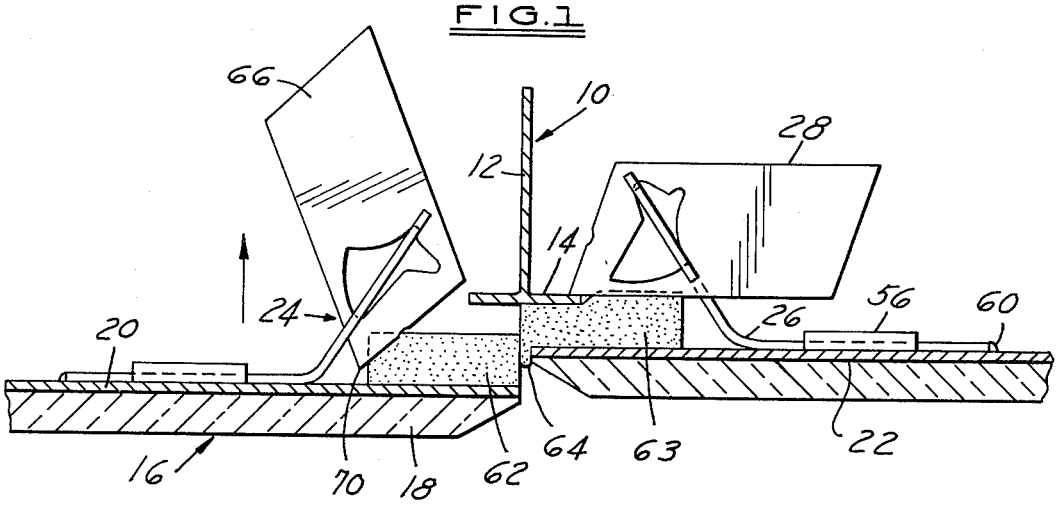
FIG. 1 is a partial cross sectional view of two panels embodying applicant's invention, one locked in position and the other in raised position.
Figure 2:
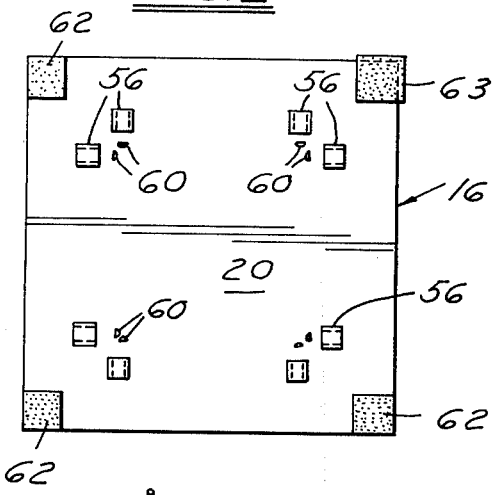
FIG. 2 is a top view of a panel embodying the invention.
Figure 4:
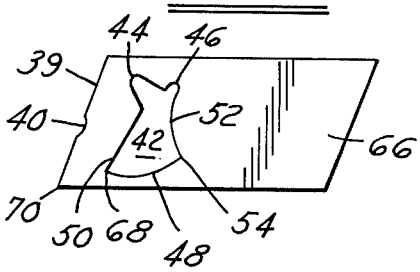
FIG. 4 is a side view of the locking member.
Figure 5:
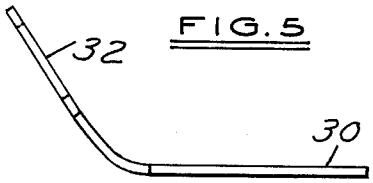
FIG. 5 is a side view of a hanger.
Figure 7:
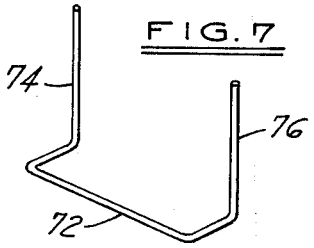
FIG. 7 is a perspective view of a key to be used with the invention.
Figure 6:
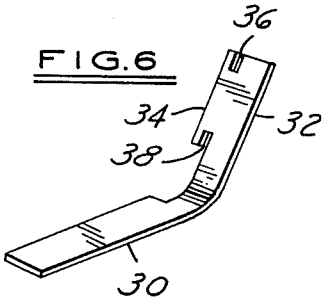
FIG. 6 is a perspective view of the hanger.
Figure 3:
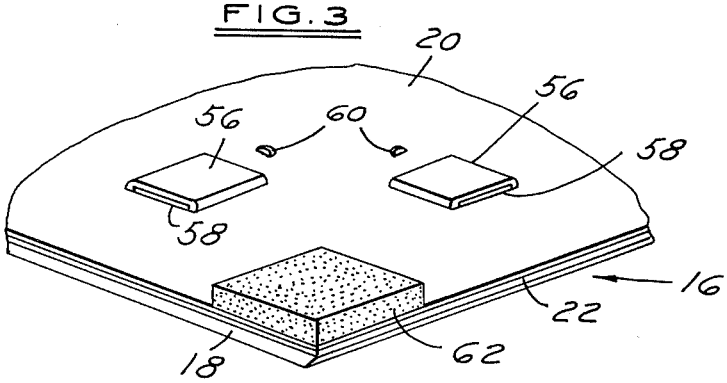
FIG. 3 is an elevated perspective view of a corner of a panel.

This invention is an improvement on present methods of suspending panels, in particular mirrored panels, from ceilings. However, it is contemplated that conventional supports 10 will be used with this invention. The conventional support has a depending shank 12 from which flanges 14 extend, giving it an inverted T-shaped cross section. The supports are suspended from the ceiling in a grid system leaving squares to be covered by the panels.

A panel 16 is provided to cover open areas between the supports. The panel has a finishing panel 18 in the form of a glass mirror which is attached to a subpanel 20 by an adhesive 22. By uses of a proper adhesive such as a mastic, the finishing panel can be pressure bonded to the subpanel, giving a strong laminated effect. Pressure bonding in shop conditions with atmosphere environment in prescribed curing time assures maximum strength. Additionally, the use of a mastic between the mirror and the subpanel will tend to hold loose portions of glass to the subpanel if the mirror, for some reason, shatters.

There is also provided a locking assembly 24 made up of two members, a hanger 26 and a locking member 28.

The hanger 26 is a flat piece of metal having a lower portion 30 and an upper portion 32. It is bent between these portions. As part of the upper portion there is a tab 34 formed by the removal of part of the metal from just before the bend to approximately a third of the way up the upper portion. The tab has two slots 36 and 38.

The locking member 28 is a parallelogram made from a flat piece of metal. On one of the smaller sides 39 of the parallelogram is made an indentation 40. There is a hole 42 in the locking member made off-center towards the side having the indentation. The hole is shaped to have two recesses 44 and 46. One recess 44 points essentially in the direction of the nearer of the two upper corners, while the other recess 46 is pointed upward and away from the indented side of the member. The lower part of the hole takes the form of a concave arc 48. A straight edge 50 of the hole connects the first recess 44 to the lower arc 48. This edge is aligned with the second recess 46. The final part of the hole 42 is a convex arc joining the second recess 46 to the lower arc 48. The two arcs join at a point 54 which is on a line drawn along the first slot 44.

There are made in the subpanel 20 prior to adhering it to the finishing panel 18, eight hanger retainers 56, two along each side of the subpanel. Each of the hanger retainers will have openings 58 in them to allow insertion of hanger 26 through the retainer. Behind each hanger retainer is a pierced stop 60. Pads are placed upon each corner of the subpanel. The pads are made of a compressible material, such as foam or a plastic. The pads need not extend over the edge of the panel, but as shown on one pad 63 an overhanging tab 64 may be added to the pad, the purpose of which will be described later.

The locking assembly is put together by placing the locking member on the hanger so that tab 34 passes through hole 42. The locking member is then pivotably held on the hanger by tab slots 36, 38. When the locking member and hanger are joined, the major portion 66 of the locking member should point in the direction of the lower hanger portion 30, away from where the support will be found. The locking assembly is then joined to the panel by placing the lower hanger portion 30 through the opening in the hanger retainers 56. The locking assembly is pushed backwards until it hits raised stop 60. The panel is now assembled so it may be placed in the grid system formed by supports 10.

Before raising the panel into the ceiling grid, all of the locking assemblies 24 are placed in their unlocked position. This is shown by the assembly in the left part of FIG. 1 and is characterized by the upper slot 36 of the hanger 26 resting in the second recess 46 of the locking member hole, while the lower slot 38 of the hanger rests near the point 68 where the lower arc 48 and straight edge 50 meet. This will cause one corner 70 of the locking member to point downward as shown in FIG. 1. When all eight of the locking assemblies are in this position, the panel is raised into the grid system. This causes the pads 62 to compress. At this point key 72 is used with the keying portion 74 inserted through the space remaining between the support 10 and the panel 16 due to pads 62. This space will also allow for ventilation of the space above the panel and shock absorbtion by the panel. The keying portion is pressed against the indented edge of the locking member most effectively at indentation 40, causing the locking member to raise slightly. This raising action causes the upper slot 36 of the hanger to leave the second recess 26 of the hole in the locking member. The greater weight of the rear portion 66 of the locking member causes that member to rotate with the upper slot entering first recess 24 and the lower slot of the hanger coming to rest near the point 54 where two arcs of the hole meet. This results in the lower corner 70 now overlying the adjoining flange 14 of the support 10. When this procedure is followed with the remaining seven locking assemblies, the panel 16 will be securely in place. Space should be retained between adjoining panels so to allow insertion of the key 72. When the appearance does not necessitate otherwise, this may be conveniently handled by using spacer members between panels such as the depending tab 64 provided as part of the corner tab 63.

It is possible to lower one of the panels after it is in place without disturbing adjacent panels by grasping key 72 along one portion 76, the keying portion 74 may be inserted in the space left between the two panels and angled through the space between the panel and the support 10. By turning the key, the keying portion will end up above flange 14. At this point the key is slid along the flange until it encounters a locking assembly. The keying portion then is moved between shank 12 and the lower corner 70 of the locking member. By then pressing up on the panel and pushing the keying portion against the lower corner of the locking member, the lock will rotate into its unlocked position. As before, this procedure is followed with the remaining locking members until they are all unlocked and then the panel may be lowered.

What is claimed is:

1. A suspended ceiling mirror assembly to be positioned on a substantially horizontal support surface comprising in combination:

a panel having a mirrored portion adhered to a subpanel portion;

a hanger joined to the subpanel;

a locking member pivotably joined to the hanger, the locking member having a first stable position overlying the support surface for suspending the panel on the support surface but rotatable on the hanger upward in a substantially vertical plane so to allow for disengagement with the support surface; and said hanger and locking member hidden from view when the panel is suspended on the support surface.

2. The assembly of claim 1 wherein the locking member may be pivoted on the hanger into a second stable position which will clear the support surface.

3. The assembly of claim 2 wherein the locking member is gravity biased so that any movement out of said second stable position will cause the locking member to rotate to said first stable position.

4. The assembly of claim 2 wherein a compressible pad is provided on the panel to engage the support surface and to allow ventilation.

5. The assembly of claim 2 wherein the mirror portion is adhered to the subpanel by a mastic.

6. The assembly of claim 3 wherein the locking member has a hole through which a tab on the hanger passes, said hole characterized by two recesses, each of which provides one of the two said stable positions when the tab rests therein.

7. A suspended ceiling panel assembly to be positioned on a substantially horizontal support surface comprising in combination:

a panel;

a hanger joined to the panel;

a locking member pivotally joined to the hanger, the locking member having a first stable position overlying the support surface for suspending the panel on the support surface but rotatable on the hanger upward in a substantially vertical plane so to allow for disengagement with the support surface; and said hanger and locking member hidden from view when the panel is suspended on the support surface.

8. The assembly of claim 7 wherein the locking member may be pivoted on the hanger into a second stable position which will clear the support surface.

9. The assembly of claim 8 wherein the locking member is gravity biased so that any movement out of said second stable position will cause the locking member to rotate to said second stable position.

10. The assembly of claim 9 wherein the locking member has a hole through which a tab on the hanger passes, said hole characterized by two recesses, each of which provides one of the two said stable positions when the tab rests therein.

11. The assembly of claim 8 wherein a compressible pad is provided to provide space between the support surface and the panel.

12. A locking assembly comprising a hanger with a tab and a locking member having a hole through which said tab passes and a locking surface, the hole characterized by two recesses, said locking member pivotable on said tab and being stable with respect to said hanger when the tab rests in either of said two recesses, but when said tab is moved out of one of said recesses it is gravity biased so to rotate into the other of said recesses and thereby align the locking surface in a horizontal position.

* * * * *